United States Patent [19]

Sangu et al.

[11] Patent Number: 4,500,775

[45] Date of Patent: Feb. 19, 1985

[54] METHOD AND APPARATUS FOR DETECTING AN OPEN CIRCUIT IN A GLOW PLUG GROUP FOR COMBINATION WITH A GLOW PLUG HEATING CONTROL CIRCUIT

[75] Inventors: Osamu Sangu, Toyota; Seiko Hotta, Oobu, both of Japan

[73] Assignee: Nippondenso Co., Ltd., Kariya, Japan

[21] Appl. No.: 480,923

[22] Filed: Mar. 31, 1983

[30] Foreign Application Priority Data

Apr. 2, 1982 [JP] Japan ..... 57-55702

[51] Int. Cl.[3] ..... H05B 1/02

[52] U.S. Cl. ..... 219/497; 219/492; 219/202; 219/508; 324/51; 340/652; 123/179 H

[58] Field of Search ..... 219/202, 203, 497, 492, 219/493, 508, 501, 483, 486; 307/39–41; 324/51, 52; 340/652, 660, 662, 664; 123/179 B, 179 H

[56] References Cited

U.S. PATENT DOCUMENTS

| | | | |
|---|---|---|---|
| 4,166,243 | 8/1979 | West et al. | 340/652 |
| 4,187,504 | 2/1980 | Cantsell | 340/652 |
| 4,340,807 | 7/1982 | Raskin et al. | 219/501 |
| 4,377,138 | 3/1983 | Mitani et al. | 219/497 |
| 4,399,781 | 8/1983 | Tsukasaki | 219/497 |
| 4,421,976 | 12/1983 | Jurek | 340/652 |

FOREIGN PATENT DOCUMENTS 26275 2/1925 Japan .

*Primary Examiner*—M. H. Paschall

*Attorney, Agent, or Firm*—Cushman, Darby & Cushman

[57] ABSTRACT

In a method and apparatus for detecting an open circuit in a glow plug group for combination with a heating control circuit of the glow plug group mounted on an internal combustion engine, an output signal generated from a detecting element connected in series with the glow-plug group while electric power is supplied to the glow plug group is applied to a first comparator to detect a change of the composite resistance of the glow plug group due to a temperature rise caused by its heating. At this time, if an open circuit failure has occurred in the glow plug group, the state of the resistance change of the glow plug group varies greatly. The first comparator produces a time measurement signal indicating a time when the composite resistance of the glow plug group has reached a predetermined value and supplies the time measurement signal to a glow plug open circuit detecting circuit. In a glow plug open circuit detecting circuit, a second comparator produces a time limit signal which continues for a preset time-length from the time of application of a power supply voltage, and a gate circuit gates the time measurement signal with the time limit signal and generates a glow plug open circuit detection signal for actuating an open circuit indicator only when the time indicated by the time measurement signal is shorter than the preset time-length.

7 Claims, 10 Drawing Figures

METHOD AND APPARATUS FOR DETECTING AN OPEN CIRCUIT IN A GLOW PLUG GROUP FOR COMBINATION WITH A GLOW PLUG HEATING CONTROL CIRCUIT

BACKGROUND OF THE INVENTION

This invention relates to a method and apparatus for detecting an open circuit occurring in a glow plug group and particularly to those suitable for use in combination with a heating control circuit for glow plugs in a Diesel engine.

DESCRIPTION OF THE PRIOR ART

As a system for controlling the preheating of a Diesel engine, there is a publicly known control system comprising a plurality of glow plugs of a low voltage rating and having a predetermined positive temperature coefficient, which are connected in parallel, and a detection resistor connected in series with the glow plug group to detect temperatures of the glow plugs, thereby feeding the glow plugs from a power supply while detecting the glow plug temperature.

With such a control system, since the resistance of each glow plug changes with an increase of its temperature, it is difficult to detect an open circuit occurring in a single glow plug from the resultant resistance value of the glow plugs.

SUMMARY OF THE INVENTION

It is an object of this invention to provide a method and apparatus for detecting an open circuit occurring in a glow plug group with high precision by means of a comparison of the time lapse on the basis of the fact that a time in which the composite resistance of the glow plugs connected in parallel reaches a predetermined value after the start of feeding the glow plugs greately changes, even when an open circuit failure has occurred in only one of the glow plugs.

According to the method and apparatus of this invention, an elapsed time in which the composite resistance of glow plugs connected in parallel reaches a predetermined resistance value after the start of feeding the glow plugs is compared with a predetermined time elapsed from the same start time point, and by utilizing the result of the comparison it is possible to detect, with high precision, an open circuit failure occurring even in a minimum number of heating members connected in parallel.

In addition, according to this invention, since the glow plug open circuit detecting circuit is combined with a heating control circuit, it is possible to provide an open circuit detecting apparatus of a simple circuit construction.

DESCRIPTION OF THE PREFERRED EMBODIMENT

Figure 1:
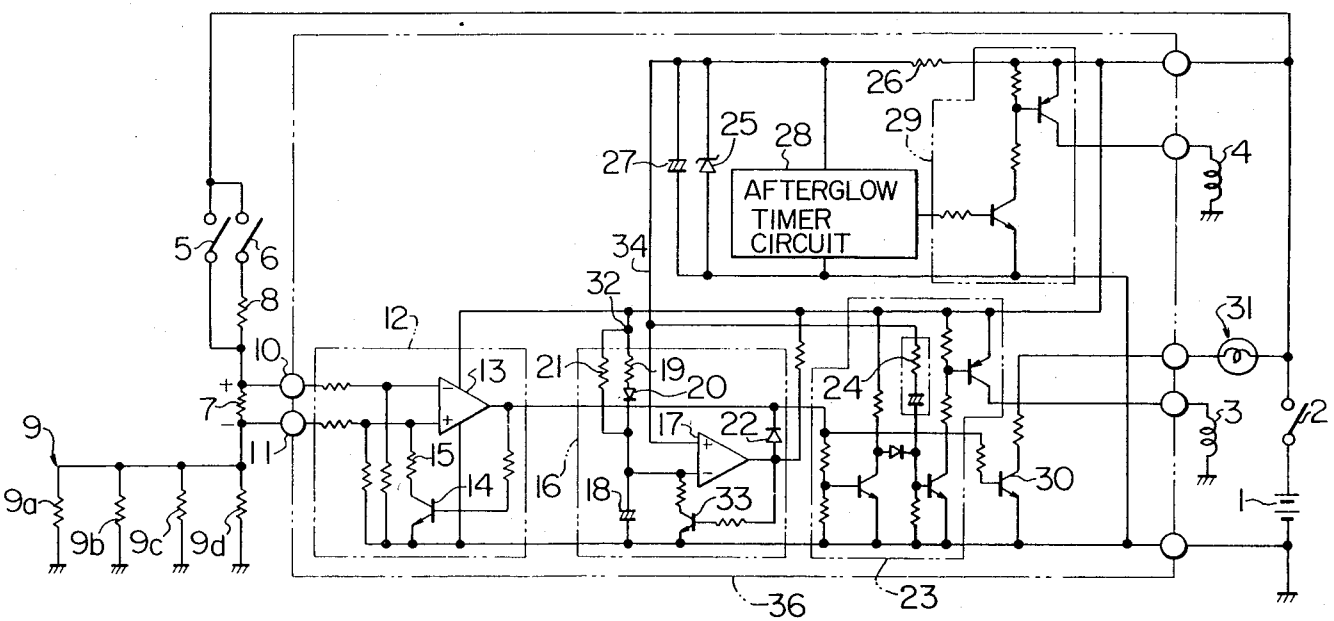
FIG. 1 is an electrical circuit diagram of an embodiment of this invention.

An embodiment of this invention will be described with reference to FIG. 1. Referring to FIG. 1, there are shown a battery designated by 1, an ignition switch 2, a main relay coil 3, a sub-relay coil 4, main relay contacts 5, sub-relay contacts 6, a sensing resistor (detecting means) 7, a series resistor 8 for causing a voltage drop therein, glow plugs (heating members) 9*a*, 9*b*, 9*c* and 9*d*, a plus-side terminal 10 of the sensing resistor 7, a minus-side terminal 11 of the sensing resistor 7, and a voltage comparator circuit 12 which outputs a "1" level signal when the voltage ratio $Vs/(Vp+Vs)$ provided by the sensing resistor 7 and the glow plug group 9 becomes a predetermined value or below. Further, there are shown a comparator designated by 13, a hysteresis providing transistor 14, a hysteresis providing resistor 15, a glow plug open circuit detecting circuit 16, a comparator 17, a capacitor 18 of an open circuit detecting timer, a resistor 19 forming a charging time constant of the capacitor 18, a diode 20 for blocking the discharge of the open circuit detecting timer capacitor 18, and a resistor 21 forming a discharge time constant of the capacitor 18. Further, there are shown a diode 22 for forcing an output of the comparator 17 to be at a low level so as to be level with an output of the comparator 13 when the latter is at a low level, a main relay drive circuit 23, a main relay drive trigger circuit 24, a Zener diode 25 for providing a stabilized power supply, a current limiting resistor 26 for the Zener diode 25, a voltage stailizing capacitor 27, an afterglow timer circuit 28, a sub-relay drive circuit 29, an indicator lamp drive transistor 30, an open circuit indicating lamp 31, a source voltage applying portion 32 of the open circuit detecting timer, a transistor 33 for forcibly discharging the capacitor 18, a stabilized voltage line 34, and a glow plug preheating control circuit 36 including the glow plug open circuit detecting circuit 16 in an embodiment of this invention.

The operation of the electric circuit of the embodiment of this invention shown in FIG. 1 will be explained hereinbelow.

Figure 2:
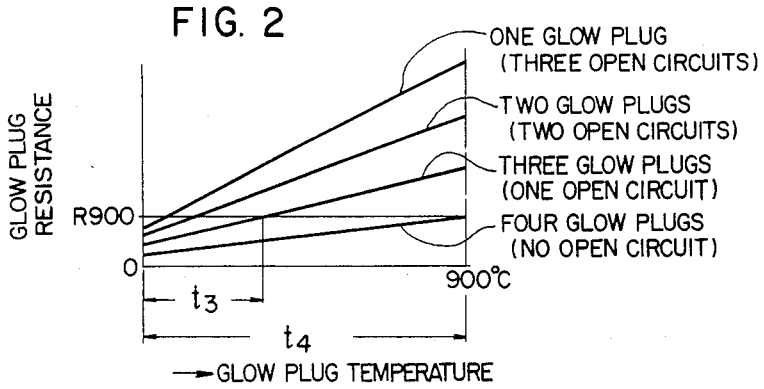
FIG. 2 is a characteristic diagram showing the relation between the combined resistance of the glow plugs and the temperature rise of the glow plugs.
Figure 7:
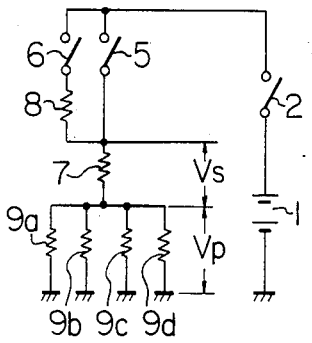
FIG. 7 is an electric connection diagram schematically showing an electric circuit construction for heating the glow plugs in the embodiment shown in FIG. 1.

Referring to FIG. 1 and FIG. 7, which shows only the power supply circuit in the embodiment of FIG. 1, when the ignition switch 2 is turned on the trigger circuit 24 operates to cause the main relay drive circuit 23 to energize the main relay coil 3, thereby closing the main relay contacts 5. At the same time, since the afterglow timer circuit 28 intermittently outputs a high level signal, the sub-relay drive circuit 29 is actuated by the intermittent output signal to energize the sub-relay coil 4, thereby closing the sub-relay contacts 6. When the main contacts 5 are closed, the battery voltage is applied through the sensing resistor 7 to the glow plug group 9. If there is no open circuit failure occurring in the glow plugs 9*a* to 9*d*, the temperature of the glow plugs increases rapidly as shown at a in FIG. 3. However, since the glow plugs 9*a* to 9*d* have a great positive temperature coefficient as shown in FIG. 2, the voltage ratio Vs/(Vp+Vs) shown in FIG. 5 decreases as the heating of the glow plugs progresses. Then, when the composite resistance of the parallel connection of the four glow plugs reaches a preset resistance level (R 900 in FIG. 2) corresponding to the resistance value at 900° C. upon the lapse of an energization time $T_4$, the output of the voltage comparator 12 takes a high level. Then, the main relay drive circuit 23 operates to de-energize the main relay coil 3 and to open the main relay contacts 5. As a result, the battery voltage is supplied through the sub-relay contacts 6 and the series resistor 8 to the glow plug group 9. Thus, after the lapse of the main relay energization time $T_4$, the temperature of the glow plugs is stabilized at about 800° C. as shown by the curve a in FIG. 3. In the voltage comparator circuit 12, when the comparator 13 produces a high level output signal, the transistor 14 is turned on, and therefore the temperature detection level is switched from the 900° C. detection level to the 750° C. detection level by the hysteresis providing operation of the transistor 14, and the switched state continues unless a case stands where the battery voltage drops and so on. Then, when the afterglow timer circuit 28 produces a low level output signal, the sub-relay coil 4 is de-energized, thereby terminating the glow plug heating.

Figure 3:
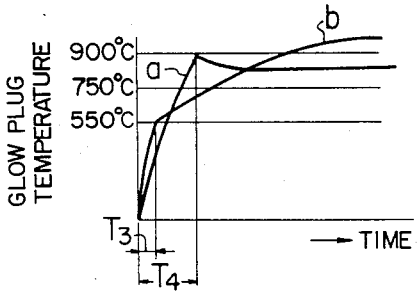
FIG. 3 is a time chart showing temperature changes of the glow plugs during their normal and abnormal operations.
Figure 5:
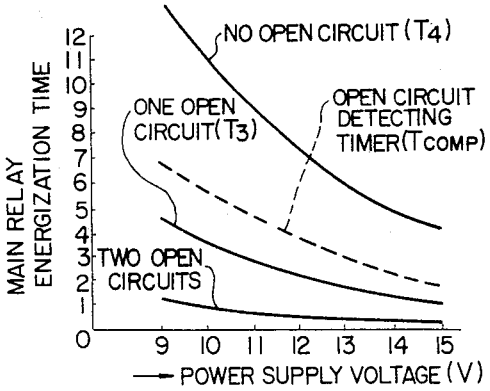
FIG. 5 is a characteristic diagram showing the relation between the energization time of the main relay and the power supply voltage with the conditions of the glow plugs used as parameters.
Figure 4:
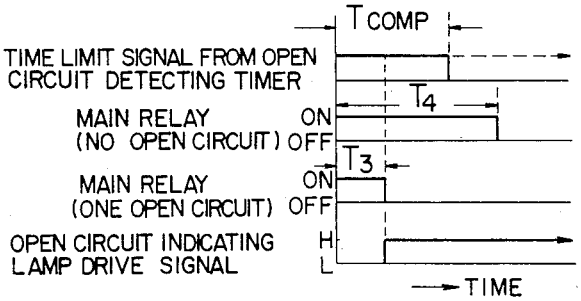
FIG. 4 is a time chart showing the fundamental operations in the detection of an open circuit failure.

If an open circuit failure has occurred in one of glow plugs 9*a* to 9*d*, the composite resistance of the parallel connection of the three remaining glow plugs reaches the preset resistance level R900 at 550° C. after the elapse of a time $T_3$ which is far shorter than the time $T_4$ in which the composite resistance of the parallel connection of the four glow plugs has reached the preset resistance level R900 at 900° C. as shown in FIGS. 2 and 3. This characteristic is shown by a curve b in FIG. 3. Thus, if a signal indicative of a time limit $T_{COMP}$, which satisfies the relation $T_3 < T_{COMP} < T_4$ as shown in FIG. 4, is generated by the open circuit detecting timer circuit when the ignition switch 2 is turned on, and then, if a logical product is made between the time limit $T_{COMP}$ indicative signal and a main relay energization start signal, it is possible to detect an open circuit failure occurring even in a single glow plug. In this case, since the time during which the main relay coil 3 is energized after the ignition switch 2 is turned on (namely, the time in which the composite resistance of the glow plug group 9 reaches the preset resistance level R900) has a great dependency on an applied source voltage as shown in FIG. 5, the $T_{COMP}$ curve per se is made dependent on an applied source voltage as indicated by a broken line in FIG. 5.

A case where an open circuit failure has occurred in one of the glow plugs will be described with reference to the embodiment shown in FIG. 1. In the glow plug open circuit detecting circuit 16, the stabilized voltage, for example, 6.8 V, is applied from the Zener diode 25 to a plus-side input of the comparator 17, and the capacitor 18 is connected between a minus-side input of the comparator 17 and ground and charged by the battery voltage through the series circuit of the resistor 19 and the diode 20 as well as through the resistor 21 of a resistance value considerably greater than that of the resistor 19. The comparator 17 tends to produce a high level output signal until the voltage across the capacitor 18 reaches the voltage across the Zener diode 25, namely, during the time limit $T_{COMP}$. However, before the composite resistance of the glow plug group 9 reaches the preset resistance level R900, the comparator 13 produces a low level output signal. Thus, the output of the comparator 17 is forcibly made to become a low level due to the short-circuiting of the high level output of the comparator 17 with the low level output of the comparator 13 through the diode 22.

Here, when an open circuit failure has occurred in one of the glow plugs 9*a* to 9*d*, the output of the comparator 13 becomes a high level after the lapse of the time $T_3$ but before the completion of the time limit $T_{COMP}$, and hence the comparator 17, which is naturally in a situation to produce a high level output signal, also produces a high level output signal, thereby turning on the transistor 33. Since the conduction of the transistor 33 causes the capacitor 18 to discharge and makes the voltage thereacross rapidly fall to substantially zero volt, the time limit $T_{COMP}$ is extended infinitely. As a result, the output of the comparator 17 continues to produce a high level output signal, thereby turning on the transistor 30 so that the open circuit indicating lamp 31 continues to be lit.

Figure 8:
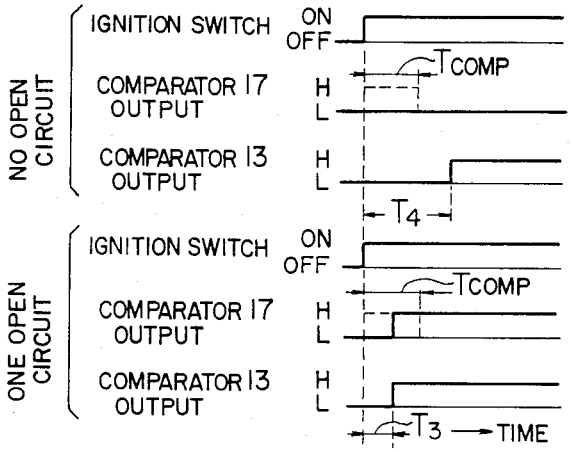
FIG. 8 is a time chart showing the operations of the electric circuits shown in FIG. 1.

When no open circuit failure occurs in the glow plugs 9*a* to 9*d*, after the time limit $T_{COMP}$ has terminated or elapsed and thus the output of the comparator 17 has fallen to a low level by itself, the output of the comparator 13 becomes a high level. Thus, the transistor 30 continues to be nonconductive, so that no open circuit failure indication results. The above-described operations are illustrated in FIG. 8. The abovementioned time limit $T_{COMP}$ is provided with a characteristic of varying automatically depending on a change of the battery voltage as shown by a broken line in FIG. 5, so that the electric circuit in FIG. 1 can operate within a wide range of the battery voltage.

Figure 6:
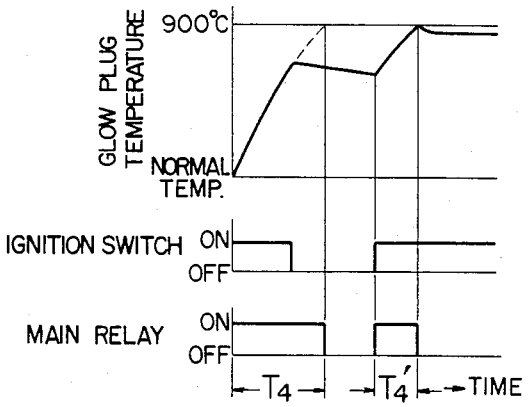
FIG. 6 is a time chart showing open circuit detecting operations in the state of a specific operation of the glow plugs.

Now, when the temperature of the glow plugs 9*a* to 9*d* is far beyond a normal temperature (approximately from −30° C. to +100° C.) at the time when the ignition switch 2 is turned on, if, for example, the ignition switch 2 is turned on to start rapid heating of the glow plugs and then turned off before the composite glow plug resistance reaches the preset resistance level R900, and again the ignition switch 2 is turned on before the glow plug temperature falls near the normal temperature, as shown in FIG. 6, a possible proper main relay energization time $T_4$ becomes shorter shown at as $T_4'$ in FIG. 6 despite that no open circuit failure has ever occurred in the glow plugs. Thus, there may be a case where the relation $T_4' < T_{COMP}$ holds, which may apparently give rise to erroneous detection of an open circuit failure even when no open circuit failure has occurred. In order to eliminate such a malfunction, the diode 20 is provided so that the capacitor 18 is charge through the parallel circuit of the resistors R19 and R21 and discharged only through the resistor 21, in other words, the discharge time constant is made greater as compared with the charging time constant. This circuit construction makes it possible to generate a time limit $T_{COMP}$ in compliance with an increase of the glow plug temperature which is cause by the on-off operation of the ignition switch 2.

Further, when the engine is restarted immediately after it has stopped operation under the condition that the glow plugs have been heated externally by the heat produced by the combustion in the engine even when the glow plugs are not fed from the power supply, the voltage across the capacitor 18 continues to be higher than or near the voltage across the Zener diode 25 for some time period after the ignition switch 2 has been turned off. Therefore, it results that the time limit $T_{COMP}$ becomes Zero, or only a shorter $T_{COMP}$, for example, shorter than $T_4'$ shown in FIG. 6, is generated depending on a time length elapsed after the ignition switch 2 has been turned off. As a result, there occurs no malfunction such as an erroneous detection of an open circuit failure when no open circuit failure has occurred.

While, in the above embodiment, the resistor 21 is connected expressly to establish a discharge time constant, if an aluminum electrolytic capacitor or the like is used as the capacitor 18, there may be a case where the provision of the resistor 21 becomes unnecessary due to a self-discharge characteristic of the capacitor used.

Figure 9:
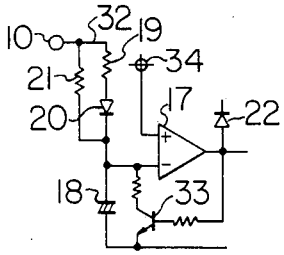
FIGS. 9 and 10 are electrical circuit diagrams showing partial modifications of the electric circuits of the embodiment shown in FIG. 1.

Further, if the source voltage applying portion of the open circuit detecting timer circuit is connected to the plus-side terminal of the sensing resistor 7 in place of the battery terminal as shown in FIG. 9, it is possible to have the value of the time limit $T_{COMP}$ preset to be exactly dependent on the voltage applied to the glow plugs.

Figure 10:
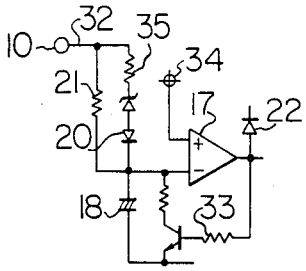

Further, it may be possible to connect a Zener diode 35 in series with the charging circuit of the capacitor 18, as shown in FIG. 10, so that the voltage characteristic of $T_{COMP}$ may be preset arbitrarily.

While, in the above embodiment, the open circuit indicating lamp 31 is continuously lit to indicate the occurrence of an open circuit failure, the continuous lighting of the open circuit indicating lamp 31 may be changed to a flashing operation of the lamp. It is also possible to use alternative indicating means such as a sound generator in place of the indicating lamp.

While, in the above embodiment, once the occurrence of an open circuit failure has been detected, the open circuit indication is maintained as long as the ignition switch 2 is not turned off, it is possible to limit an indication time period by setting a time limit for the open circuit indication or by using a logic circuit to which a starter signal or the like is applied as an input signal thereto.

In addition, the generation of $T_{COMP}$ and the storage of the open circuit failure detection may be attained not only by the electric circuit of the above embodiment but also by the use of the other electric circuit means, a microcomputer, or the like.

We claim:

1. A method for detecting an open circuit occurring in a glow plug group including a plurality of glow plugs connected in parallel, for combination with a glow plug heating control circuit for controlling the supply of electric powe to said glow plug group on the basis of an output signal indicative of a change of the composite resistance of said glow plug group produced from a detecting element connected in series with said glow plug group while detecting a heating condition of said glow plug group, after a power supply switch is turned on, comprising the steps of:

generating a heating time signal indicative of a time length in which the heating condition of said glow plug group detected by said detecting element reaches a predetermined heating condition after the start of the supply of electric power to said glow plug group initiated by the turning-on of said power supply switch;

generating a time limit signal indicative of a preset time-length starting in response to the turning-on of said power supply switch;

comparing the heating time signal with the time limit signal; and producing an open circuit detection signal for indicating the occurrence of an open circuit in said glow plug group only when the time length indicated by the heating time signal is shorter than the preset time-length.

2. A method according to claim 1, wherein the preset time-length is corrected in accordance with one of a power supply voltage and a voltage related thereto at the time of the turning-on of said power supply switch.

3. A method according to claim 1, wherein the preset time-length is corrected in accordance with a temperature of said glow plug group at the start of the supply of electric power to said glow plug group.

4. An apparatus for detecting an open circuit occurring in a glow plug group including a plurality of glow plugs connected in parallel, for combination with a glow plug heating control circuit for controlling an electric power supply to said glow plug group through a power supply switch on the basis of an output signal indicative of a change of the composite resistance of said glow plug group produced from a detecting element connected in series with said glow plug group while detecting a heating condition of said glow plug group, after said power supply switch is turned on, comprising:

first comparator means for receiving output signals from said detecting element and producing a heating condition detection signal indicative of a heating condition of said glow plug group;

a glow plug open circuit detecting circuit including: time signal generating means for starting its operation in response to the turning-on of said power supply switch and producing a time lapse signal indicative of a time elapsed from the start of its operation; second comparator means for receiving the time lapse signal from said time signal generating means and a preset time-length signal indicative of a preset time-length and producing a time limit signal which continues during the preset time-length; and gate means for receiving the heating condition detection signal from said first comparator means and the time limit signal from said second comparator means, said gate means gating the time limit signal with the heating condition detection signal and thereby producing a glow plug open circuit detection signal indicative of the detection of the occurrence of an open circuit in said glow plug group only when said gate means has received the heating condition detection signal while said gate means is receiving the time limit signal; and open circuit indicating means for indicating the occurrence of an open circuit in said glow plug group in response to the glow plug open circuit detection signal from said glow plug open circuit detecting circuit.

5. An apparatus according to claim 4, wherein said second comparator means of said glow plug open circuit detecting circuit comprises hold circuit means constructed to be driven by the glow plug open circuit detection signal from said gate means of said glow plug open circuit detecting circuit to hold a state of having detected the occurrence of an open circuit of said glow plug open circuit detecting circuit.

6. An apparatus according to claim 4, a power supply input to said time signal generating means of said glow plug open circuit detecting circuit is connected to a power supply side end of said detecting element connected in series with said glow plug group.

7. An apparatus according to claim 5, a power supply input to said time signal generating means of said glow plug open circuit detecting circuit is connected to a power supply side end of said detecting element connected in series with said glow plug group.

* * * * *